US005265069A

United States Patent [19]

Wardle

[11] Patent Number: 5,265,069

[45] Date of Patent: Nov. 23, 1993

[54] BLANKET ARRAY ADHESION SYSTEM

[75] Inventor: William F. Wardle, Mystic, Conn.

[73] Assignee: The United States of America as represented by the Secretary of the Navy, Washington, D.C.

[21] Appl. No.: 35,111

[22] Filed: Apr. 27, 1979

[51] Int. Cl.[5] ..... H04R 17/00

[52] U.S. Cl. ..... 367/173; 367/153; 367/165

[58] Field of Search ..... 367/140, 153, 155, 156, 367/165, 173; 114/222

[56] References Cited

U.S. PATENT DOCUMENTS

| | | | |
|---|---|---|---|
| 3,492,634 | 1/1970 | Massa | 367/173 |
| 3,907,062 | 9/1975 | Brigham et al. | 367/153 |
| 4,140,992 | 2/1979 | Wardle | 367/153 |
| 4,158,189 | 6/1979 | Wardle | 367/153 |

FOREIGN PATENT DOCUMENTS

| | | | |
|---|---|---|---|
| 2730116 | 1/1979 | Fed. Rep. of Germany | 367/173 |

*Primary Examiner*—Harold J. Tudor

*Attorney, Agent, or Firm*—Michael J. McGowan; Prithvi C. Lall; Michael F. Oglo

[57] ABSTRACT

An adhesion system utilizes a pair of liquid suction systems for adhering a blanket transducer array to the external hull of a vessel. Both liquid suction systems can be individually controlled. The first suction system produces a low liquid pressure under rigid saucer-like shells and causes these shells to press against the hull surface. The second suction system operates similar to the first and is located in the area surrounding the shells. In operation it is possible to enhance the adhering ability of the system by maintaining a lower pressure in the first system. This is feasible due to the rigidity of the material in the first system.

7 Claims, 3 Drawing Sheets

BLANKET ARRAY ADHESION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention generally relates to adhesion systems and more particularly to a blanket array adhesion system. The invention permits blanket arrays to be rapidly installed on, firmly adhered to, and rapidly removed from the hull of a vessel or other surfaces either above or below the water line with no damage to either the array or the hull.

Currently, sticky adhesive substances are used for attaching blanket sonar arrays, associated cables, acoustic baffles and miscellaneous parts. These adhesive substances are capable of achieving a reliable high strength bond. However, many disadvantages result from their use. One disadvantage is the excessive care in the preparation of hull surfaces; this includes drying, sanding, priming, etc. and sometimes makes drydocking necessary. Other problems involve array removal procedures that are generally difficult and can involve cutting and the application of solvents, where both methods tend to damage or destroy the array. In addition, the permanent nature of the adhesive bond precludes timely inspections of the portion of the external hull surface covered by an array and limits or precludes welding or the application of other heat generating processes to hull plates, ribs, etc. for fear the heat generated might damage the array and/or the adhesive bond. Regardless of the care taken with an adhesive bond, there is always the possibility that the bond may not be perfect or remain perfect and that non-obvious cracks, pin hole leaks, porosity, etc. may develop that will allow salt water and air to penetrate to the hull surface and cause the hull to corrode undetected, possibly for long periods. Crevice corrosion is a particular danger. The above problems caused by adhesives and the permanent nature of the adhesive bond tend to discourage use of blanket arrays for temporary applications such as noise studies or range pingers.

SUMMARY OF THE INVENTION

It is, therefore, a general object of the present invention to provide an improved adhesion system. The improved system has none of the drawbacks of the prior art adhesives.

This is accomplished in accordance with the present invention by installing two liquid suction systems within a single blanket array. This causes the blanket array to adhere to an external hull surface. Means are provided to control the composition and pressure of the liquids employed within the suction system.

A first suction system produces a low liquid pressure under rigid saucer-like shells and causes these shells to press against the hull surface. A second suction system produces a low liquid pressure in the spaces between shells, and between the shells and the array periphery to similarly produce an adhesion force, it is feasible to keep a lower pressure under the shells than in the spaces between shells because the shells press down hard on gaskets which seal their contact with the hull and because the rigid shells will not flex and cause dimpling.

Some moderately low pressure is maintained in the spaces between shells and between shells and the array periphery. The moderate pressure is sufficiently close to the ambient pressure to prevent objectionable dimpling of the elastomeric body of the array and to lessen the likelihood of leaks in the peripheral seal. Whereas there may be exceptions, because they can sustain the lower pressure, it is intended that the shells provide the greater part of the adhesion force. Since the shell diameters can be made relatively small, the shells should be capable of sealing and thus adhering to curved hull surfaces.

Each shell is curved and its convex side is attached to the interior of a blanket array. The concave side presses against the external hull surface through a gasket. The gasket is sandwiched between the rim of the shell and the hull surface and serves to seal the space enclosed between the shell and the hull surface. A liquid pressure under each shell, while substantially below the ambient pressure, is purposely kept high enough to prevent the enclosed liquid from boiling.

A portion of the array's interior surface which is not covered by shells is provided with small button-like spacers which press against the hull surface and serve to reduce array dimpling. They form a uniformly thick space between the hull surface and the array in which liquid can circulate. Since these spacers sustain point loads as contrasted to the distributed loads on the gaskets and since they do not function as a seal, they can be constructed of harder material than the gaskets consistent with not damaging an exterior hull coating.

The wedge-like edge of the array's fairing consists of a transparent elastomeric strip bonded to the remainder of the fairing. Transparent double-sided adhesive tape is used to seal the contact between the transparent strip and the hull surface. The use of transparent materials permits the inspection of the seal and the hull surface under and adjacent to the seal.

Both suction systems are configured to circulate fresh water and then treated liquid, the purpose being to flush out and replace salt water and/or air entrapped during array installation. The fresh water flush conserves treated liquid. The treated liquid will have properties which inhibit corrosion and other damaging processes. Flushing techniques include vortex circulation within shells, serially connected shells, features which facilitate movement of bubbles through the system, and arrangements of shells that encourage liquid channeling in the spaces not covered by shells. An additional technique to the foregoing, whereby adjacent sets of shells alternately lift off the hull surface to permit a more complete flushing operation, is also included.

DESCRIPTION OF THE PREFERRED EMBODIMENTS

Figure 1:
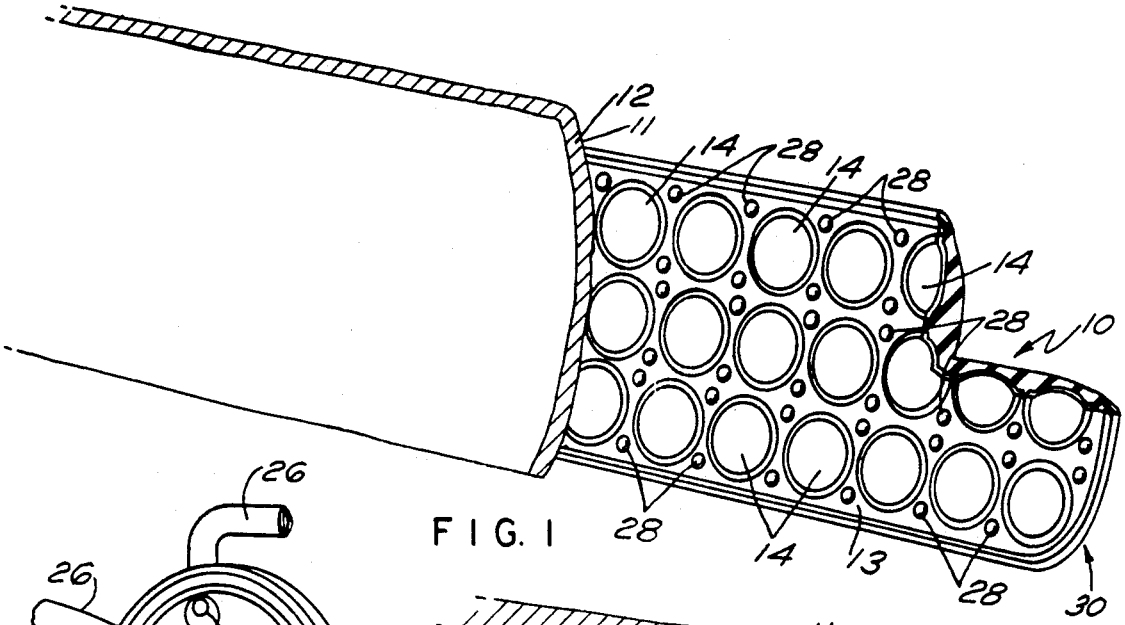
FIG. 1 is a perspective view, partially cutaway, of a blanket array attached to a hull surface by means of a liquid suction adhesion system.

Referring now to FIG. 1 there is shown a blanket array 10 mounted on an external hull surface 11. The blanket array 10 is comprised of elastomeric material and contains sonar sensors for detection purposes along with associated components and cabling. Part of hull plating 12 is cut away to permit the interior surface 13 of blanket array 10 to be viewed. A corner of blanket array 10 is also cut away to show its cross-sectional configuration. The array 10 is faired to the hull surface 11 for streamlining purposes. A plurality of shells 14 that are made of a stiff material such as reinforced plastic or fiberglas constitute a principal element of the adhesion system. These shells 14 can be molded into the array 10 or independently affixed to the array 10 by means of adhesives. The system is suitable for the attachment of state-of-the-art arrays wherein the sonar components are molded into an elastomer sheet or where the sonar components are inserted within grooves or cavities formed in the interior side of the elastomer sheet.

The portion of the interior blanket array surface 13 not covered by shells 14 contains small rounded protrusions 28 which press against hull surface 11 and serve as spacers to help prevent the blanket array 10 from dimpling inward. These protrusions can be made of plastic or fiberglas. They allow liquids to circulate in the space not covered by shells 14. A specially configured strip 30 serves to seal the periphery of the array 10.

Figure 2:
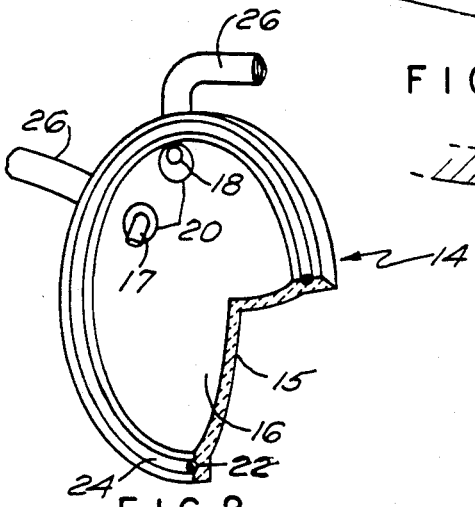
FIG. 2 is a perspective view, partially cutaway, showing details of one shell of the type employed in the adhesion system of FIG. 1.

Refer now also to FIG. 2. The convex side 15 of each shell 14 is firmly attached to the interior surface 13 of blanket array 10. The interior surface 13 is indented to accommodate shells 14. The concave sides 16 of shells 14 press against bull surface 11. Each shell 14 contains an inlet nozzle 17 and outlet fitting 18 positioned on the concave side 16 of each shell 14. The inlet nozzle 17 and the outlet 18 pass through the wall of each shell 14 in watertight bushings 20. On the concave side 16 of the rim of each shell 14 there is a circular gasket groove 22 within which is an O-ring gasket 24.

Each inlet nozzle 17 is oriented to induce a circular vortex-like flow of a liquid within each shell 14. Each output fitting 18 is located as high as possible within each shell 14 to facilitate the removal of entrapped air. The inlet nozzles 17 and output fittings 18 of all shells 14 are connected with tubing 26 to form a single series connected liquid circuit. The velocity of liquid in tubing 26 will be high enough to cause gas bubbles to be swept along with the moving liquid regardless of the orientation of the tubing 26.

Figure 3:
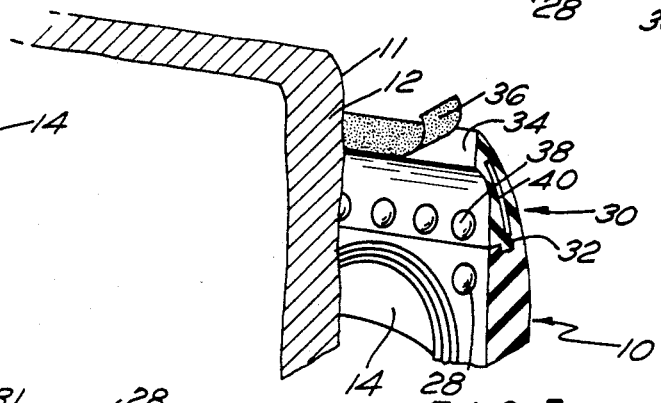
FIG. 3 is a perspective view, partially cutaway, showing details of the transparent faired peripheral seal of the adhesion system of FIG. 1.

Refer now also to FIG. 3 which details how the edge of blanket array 10 is sealed to the hull surface 11. The wedge-shaped peripheral section of the fairing is a transparent elastomer strip 30 firmly bonded to the remainder of array 10 at joint 32. The transparent strip 30 has a cross-section which includes a face 34 which is fastened to the hull surface 11 with a transparent adhesive tape 36. The adhesive tape 36 has a different adhesive on each side such that one adhesive is compatible with the material of the transparent strip 30, the other with the coating on the hull surface 11. The adhesives are nonsetting types which permit the tape 36 to be removed without damage to the transparent strip 30 or the hull surface 11.

As can be seen in FIG. 3, the transparent strip 30 extends beyond face 34 over a portion of the liquid-filled space not covered by shells 14. The strip 30 is separated from the hull surface 11 in this region by button-like protrusions 38. These protrusions 38 are made similar to protrusions 28 and serve a similar purpose. The reason for the transparent strips's 30 extension is to insure that all of the adhesive joint at face 34 can be observed and that a small amount of the space surrounding protrusions 38 and to be occupied by the treated liquid can also be observed. In addition, the sectional shape allows the creation of an inward force to be developed in the space between face 34 and the protrusions 38 to press inward on face 34, thus helping to keep the adhesive joint at face 34 sealed. A row of small stiff reinforcements 40 are molded into transparent strip 30 to keep the cavity they bridge from collapsing. The size and spacing of reinforcements 40 are such that reinforcements 40 do not impede inspection of the seal between face 34 and hull surface 11.

During assembly the application of the adhesive tape 36 follows the attachment of shells 14 to hull surface 11. The cleaning of the hull surface 11 immediately under face 34 is facilitated by raising the transparent strip 30 and a small portion of the attached array 10 a short distance from hull surface 11. The use of a transparent strip 30 and transparent adhesive tape 36 permits observation of any water, air or other impurity in the seal at face 34 and thus aids in their removal by pressure or other means. Transparent colored adhesives can be used to further aid in the inspection of the peripheral seal. The adhesive on each side of tape 36 would have its own distinctive color. A pair of colors would be chosen so that one color would not block observation of the other. For example, the exterior color must transmit the interior color as well as a distinctive color of its own. Complementary colors would be avoided.

Figure 4:
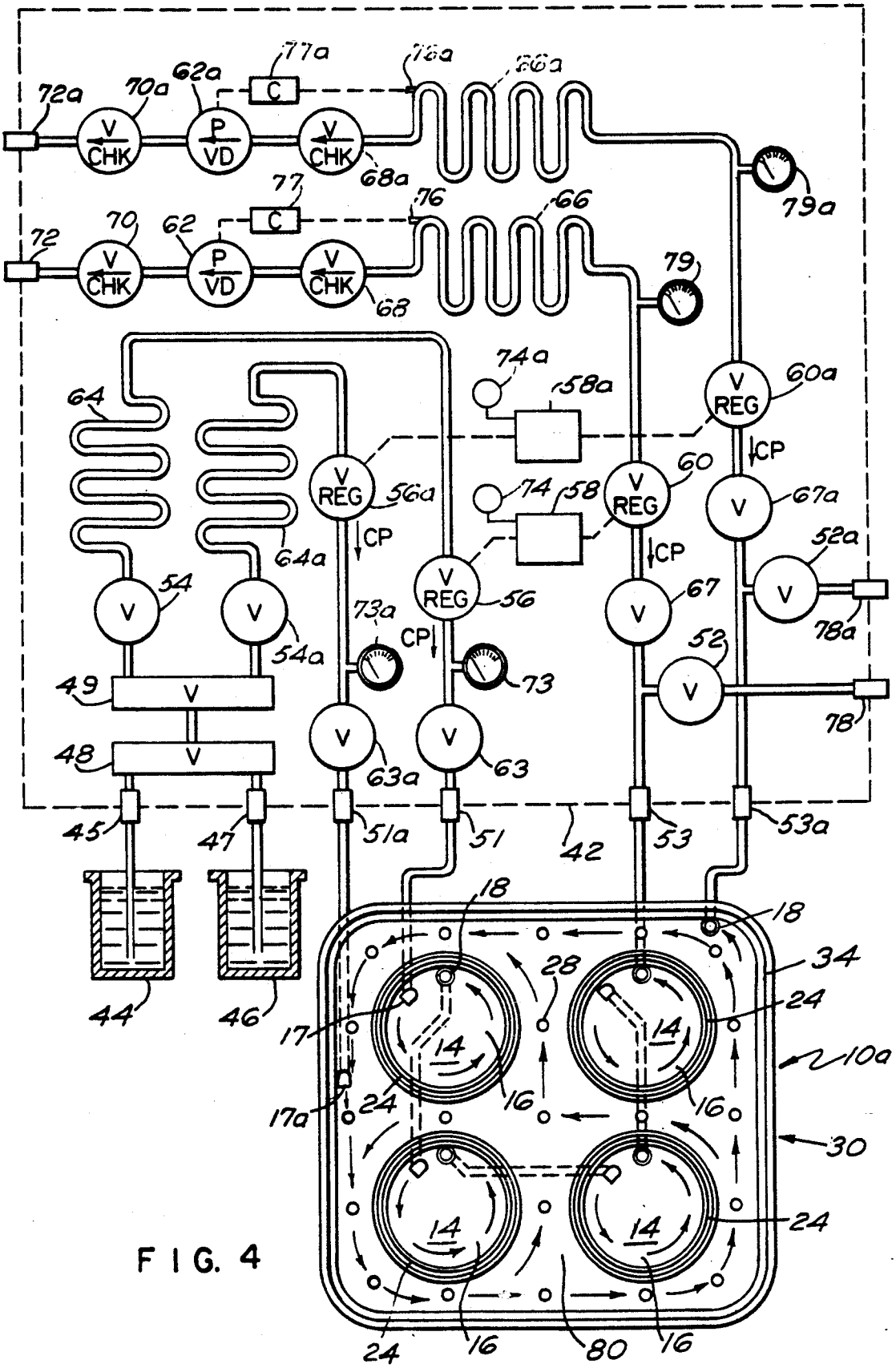
FIG. 4 is a schematic diagram of the present invention including means for flushing and maintenance of pressures in the adhesion system.

Referring now to FIG. 4, there is shown a schematic diagram of the liquid suction adhesion system including the means for flushing and maintenance of desired pressures within the system.

Components enclosed by dashed line 42 are located within the hull of a surface vessel or free flooding space of a submarine. The blanket array **10*a* is adhered to the exterior hull surface on both surface vessels and submarines. For convenience, the blanket array 10*a* has only four shells 14 shown. It is to be understood a typical system could have a different number of shells 14 such as that of FIG. 1. The function of the components shown will be discernible in the following description of the array 10*a* installation and removal procedures. Some of the components to be explained are not visible in FIG. 4 but were referred to in FIGS. 1–3**, inclusive.

Prior to the actual attachment of blanket array **10*a* various connections and valve settings must be made and a supply of fresh water 44 and treated liquid 46** made available.

The fresh water 44 and treated liquid 46 would normally be supplied from tanks that are placed in a convenient location. The treated liquid 46 could be any of various solutions containing benzotriazole, molybdates, chromates, zinc or other chemicals suitable for inhibiting corrosion, biological growth and other deleterious actions. The fresh water 44 might be preboiled, vacuum treated, filtered, etc. to remove gases and impurities. The fresh water 44 and treated liquid 46 are connected to the system via respective couplings 45 and 47. Blanket array 10*a* is connected to the system via couplings 51, 51*a*, 53 and 53*a*. Distribution valve 48 selects either fresh water 44 or treated liquid 46. Distribution valve 49 channels the selected liquid to the desired path.

In initially setting the components for the flushing and adhering of the shells 14, valves 52, 52*a*, 54*a*, 63*a* and 67*a* are closed, and valves 54, 63 and 67 are opened. The distribution valve 48 is set to deliver fresh water 44 and distribution valve 49 is opened to valve 54 and closed to valve 54*a*. Input pressure regulation valves 56 and 56*a* are set by means of respective controls 58 and 58*a* to which are attached ambient pressure sensors 74 and 74*a*, to deliver a pressure which is a small amount below ambient pressure. Output pressure regulation valves 60 and 60*a*, which are also connected to respective controls 58 and 58*a*, are set to open at an input pressure which is a small amount below the pressure delivered by valves 56 and 56*a*. It is to be noted that valves 56*a* and 60*a* are set at this time for convenience, although they are not used at present for operation.

Thus, after couplings 45, 47, 51, 51*a*, 53 and 53*a* are connected, and after valves 48, 49, 52, 52*a*, 54, 54*a*, 56, 56*a*, 60, 60*a*, 63, 63*a*, 67 and 67*a* are properly set, the blanket array 10*a* is positioned in a desired location on the hull surface. While held in this position, the variable discharge pump 62 is turned on. The suction created by pump 62 causes valves 60 and 56 to open. This lowers the pressure within spaces enclosed by shells 14 to below ambient pressure. This causes shells 14 to adhere to the hull surface 11 and will draw fresh water 44 through a path comprising coupling 45, distribution valves 48 and 49, valve 54, liquid accumulator 64, pressure regulation valve 56, valve 63, coupling 51, a plurality of series connected shells 14, coupling 53, valve 67, pressure regulation valve 60, vacuum accumulator 66, check valve 68, variable discharge pump 62, check valve 70, and discharge fitting 72. As fresh water 44 flows through the system, entrapped salt water and/or air will be flushed out. All components are designed for a thorough flushing. The arrows within shells 14 show the vortex-like movement of the liquid during the flushing operation. The fresh water 44 serves as an intermediate flushing agent to conserve the treated liquid 46.

The small pressure differential between the interior side 16 and exterior side 15 of shells 14 produced by the settings of the two regulator valves 56 and 60 cause the blanket array 10*a* to press lightly against the hull surface. The O-rings 24 are lightly compressed with a positive but small surface contact. Fresh water 44 is circulated until no trace of salt water and/or air is discernible at discharge 72. Chemical indicators, instrumentation, etc., may be employed at discharge 72 to measure the composition of the liquid being discharged. When it has been determined that the salt water and/or air have been flushed from the system, the pump 62 is turned off. The internal system pressure is monitored by pressure gauge 73 to determine if seals and other parts are free of leaks.

When it has been determined that there is a tight seal, the distribution valve 49 is switched and various valves are reset to deliver fresh water 44 to the system that includes the thin space or channel 80 created by button-like protrusions 28 of blanket array 10*a*. The operation is similar to that just described. The components having the lower case letter are operated in place of the plain numerical components.

When it has been determined that there is a tight seal in the system that includes interior channel 80, the distribution valves 48 and 49 are switched and various valves are again set to deliver treated liquid from supply 46 to the system that includes shells 14. Pump 62 is again turned on. Treated liquid is allowed to circulate until no trace of fresh water appears at the discharge 72. Discharge pump 62 is then turned off.

When it has been determined that there is a tight seal, the distribution valve 49 is switched and various valves are again reset to deliver treated liquid 46 to the system that includes interior channel 80 of blanket array 10*a*. The operation is similar to that just described.

After fresh water 44 has been flushed out of the array 10*a*, all spaces are full of treated liquid, and valves 54 and 54*a* are closed, regulator valves 56 and 60 are readjusted via control 58 to maintain a pressure under shells 14 so that the contained treated liquid is just below its boiling point. To prevent movement of liquid in the system, valve 60 is set to discharge at an input pressure which is slightly higher than the pressure delivered by valve 56. Pump 62 is turned on. Valve 60 opens until the pressure is reduced to its new setting. Then valve 60 closes. Valve 56 remains closed. The resetting of valves 56 and 60 cause a significant lowering of pressure within shells 14 thus causing the blanket array 10*a* to adhere to the hull surface 11 more firmly. The O-ring gaskets 24 further compress and increase their contact area. Treated liquid is trapped under the added portion of the contact areas between the gaskets 24 and hull surface 11 and between the gaskets 24 and the gasket grooves 22.

At this point the pump 62 is turned off and the pressure monitored by gauge 73 to detect leaks. If the seals appear to be working the pump 62 is again turned on. The continued operation of pump 62 reduces the pressure in the vacuum accumulator 66 which is full of treated liquid. Treated liquid begins to be pumped out of vacuum accumulator 66. As the pressure in accumulator 66 falls below the saturated vapor pressure the remaining contained treated liquid will begin to boil. The combination of liquid and vapor so produced will be exhausted through check valve 68, pump 62, check valve 70, and discharge 72. If necessary, pump 62 is slowed and accumulator 66 heated to prevent the treated liquid in accumulator 66 from freezing.

When all the treated liquid in accumulator 66 is evaporated and accumulator 66 is at the lowest pressure capable of being achieved by pump 62, then pump 62 is turned off. This process is accomplished automatically by control 77 to which is attached pressure sensor 76 in vacuum accumulator 66. Check valve 68 prevents air or liquid from flowing back into accumulator 66. Check valve 70 prevents air or liquid from flowing back into pump 62.

Following the setting of pressure within shells 14, the pressure within interior channel area 80 is set in a similar manner except that the pressure established in channel 80 is much closer to the ambient pressure than the pressure under shells 14. This is to prevent dimpling of the array 10*a*.

When the adhesion system described is subjected to change in depth, it is desirable to maintain a constant differential pressure between channel area 80 and the ambient pressure. This is accomplished with control 58*a* which utilizes data from ambient pressure sensor 74*a*. Liquid accumulator 64*a* supplies the required treated fluid and vacuum accumulator 66*a* the required low pressure and storage for excess fluid. Liquid accumulator 64*a* comprises collapsible tubes through which ambient pressure is transferred through the walls of the tubing to the treated fluid stored within the tubes. The vacuum accumulator 66*a* comprises rigid tubes strong enough to sustain the highest external absolute pressure the array may experience. The liquid accumulator 64*a* supplies the small amount of fluid passed by pressure regulation valve 56*a* when a submarine's depth is increased and the vacuum accumulator 66*a* receives the small amount of fluid passed by pressure regulation valve 60*a* when a submarine's depth is decreased. All accumulators 64, 64*a*, 66 and 66*a* are comprised of tubes to facilitate their flushing. Liquid accumulators 64 and 64*a* are similar in construction as are vacuum accumulators 66 and 66*a*. These tubes may be constructed of translucent or transparent walls to facilitate monitoring the liquids and gases within. The liquid accumulator tubes may contain means to maintain a small cross-section path through a completely collapsed tube. Grooves in the tube walls or in strips of material placed within the tubes would perform this function.

Small leaks in a suction system will cause the pressure to rise on the input side of valves 60 and 60*a* thus causing these valves to discharge liquid into respective accumulators 66 and 66*a*. A constant adhesion force will be maintained on blanket array 10*a* in the event of such leakage. Devices which indicate the status of accumulators 66 and 66*a* such as pressure sensors 76 and 76*a* or gauges 79 and 79*a* located within or adjacent to the accumulators 66 and 66*a* will warn that the accumulators 66 and 66*a* have been utilized and that the treated liquid may be contaminated with salt water and/or air. As a further safeguard, other means such as viewing the presence of unusual amounts of liquid within a vacuum accumulator can be used to indicate that the liquid within array 10*a* may be contaminated. If the treated liquid 46 is contaminated the system will need maintenance and recharging in order to prevent serious corrosion.

At this point it should be noted that pumps 62 and 62*a* remain operable after array 10*a* attachment is complete and are supplied with power from either vessel power of self-contained batteries to compensate for large leaks in the suction system. Pump 62 or 62*a* will turn on if the pressure in respective vacuum accumulator 66 or 66*a* rises above a specified level. Controls 77 or 77*a* perform this function. With this arrangement the array 10*a* is not subjected to pump 62 or 62*a* noise in the event minor leaks develop. Another function of vacuum accumulators 66 and 66*a* involve the effect of shock waves on array 10*a*. If the negative pressure generated by a shock wave causes the treated liquid 46 to cavitate, gas or boil, the vacuum accumulators 66 and 66*a* help to quickly restore the low pressure needed to maintain adhesion. The action of accumulators 66 and 66*a* are expected to be many times faster than the start-up time of pumps 62 and 62*a*.

When it is desired to remove blanket array 10*a*, power to pumps 62 and 62*a* are shut off and valves 52 and 52*a* are opened. Water and/or air will flow into the suction system from vents 78 and 78*a* raising the pressure within shells 14 to the ambient pressure. The latter can also be accomplished by opening valves 54 and 54*a*, and adjusting valves 56 and 56*a* to permit the free flow of water and/or air into the suction system.

Figure 5:
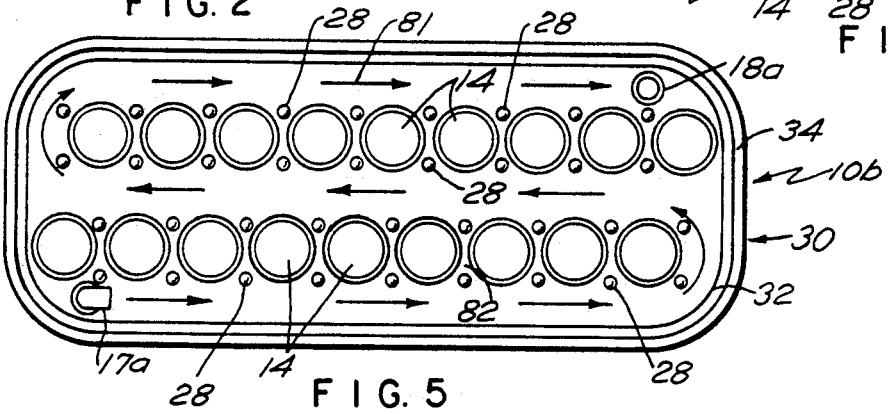
FIG. 5 is a plan view of the interior side of a blanket array showing the positioning of shells for liquid channeling purposes.

Referring now to FIG. 5, there is shown an alternate arrangement of shells 14 having a channel 81 indicated by arrows. Input and output fittings 17*a* and 18*a* introduce and remove liquid from channel 81. Since there are small gaps 82 between adjacent shells 14 the channel 81 is not tight and fluid can leak through these gaps 82. This leaking fluid serves to flush the gaps 82 and is a deliberate part of the flushing function. This arrangement optimizes the channeling of liquid during the flushing operations.

Figure 6:
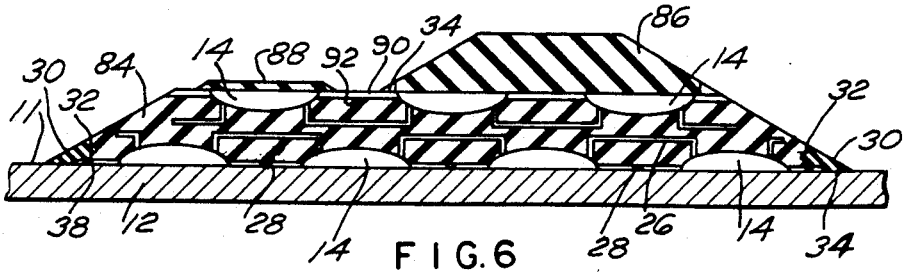
FIG. 6 is a sectional view of an alternate configuration of an adhesion system comprising a double-sided adhesion sheet.

The adhesion systems described can be installed on both sides of an elastomer or non-elastomer sheet and serve to bind two surfaces, for example a hull surface to a blanket array surface, blanket baffle surface, etc. or any combination of such surfaces together. A suction face not in contact with a metal hull may not require the flushing means included in the preferred embodiment and therefore may be more simply configured. Referring now to FIG. 6, there is shown a sheet 84 with shells 14 mounted on both faces and serving to bind blanket array 86 to hull surface 11. A mirror surface 92 bordering transparent layer 90 makes adhesive peripheral seal at face 34 visible. Faired covers 88 cover unused shells 14.

An alternative two-sided binding sheet may substitute open double sided shells for the shells described in FIG. 6. Such double sided shells would span the thickness of the binding sheet and result in a thinner sheet. The disadvantage is that the binding sheet and array would have to be installed simultaneously.

Refer now to FIGS. 7A–E. A more complete flushing technique can be implemented by employing two separate sets of shells 14. It will be understood that the details in the flushing procedures including the replacement of salt water and/or air with treated liquid and the provision for the maintenance of the adhesive force heretofore described in this invention will be implied in the flushing procedure referred to in the following description. An exception is made of those parts of the flushing procedure which pertains to using light differential pressures to minimize contact areas which contain trapped salt water.

Figure 7A:
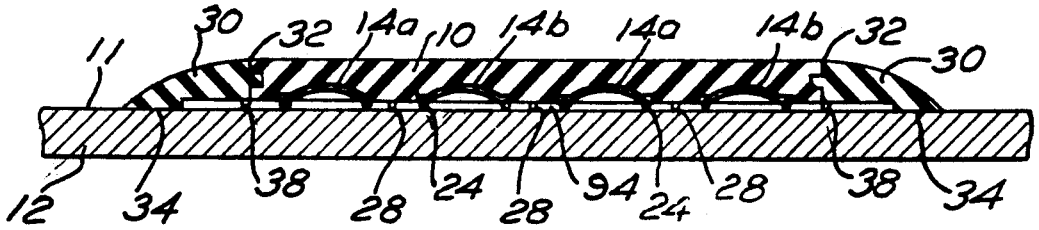
FIGS. 7A–E are sectional views of a second alternate configuration of an adhesion system that illustrate the sequential steps involved in lifting and flushing array sections.
Figure 7B:
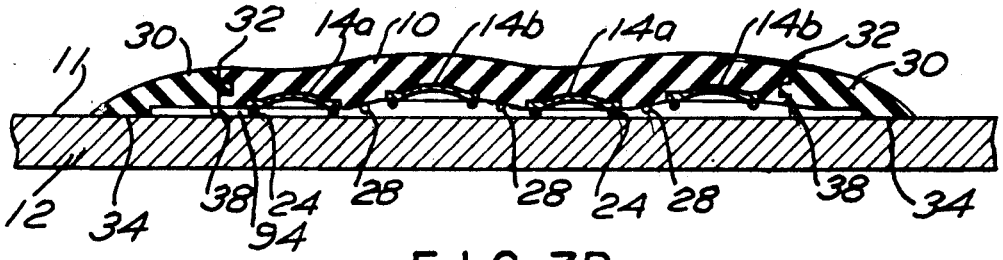
Figure 7C:
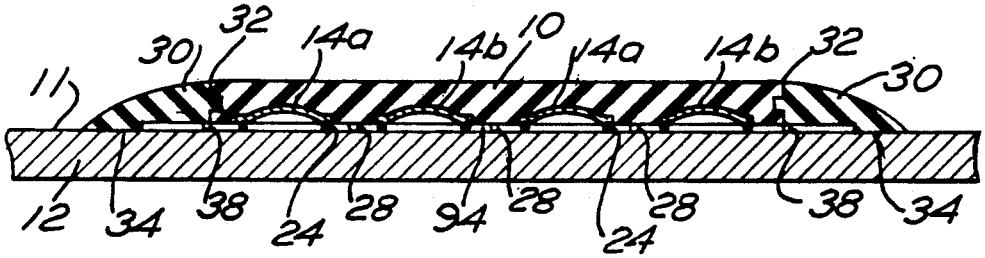
Figure 7D:
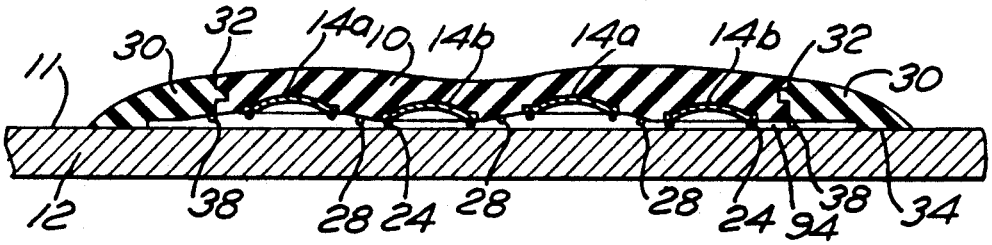
Figure 7E:
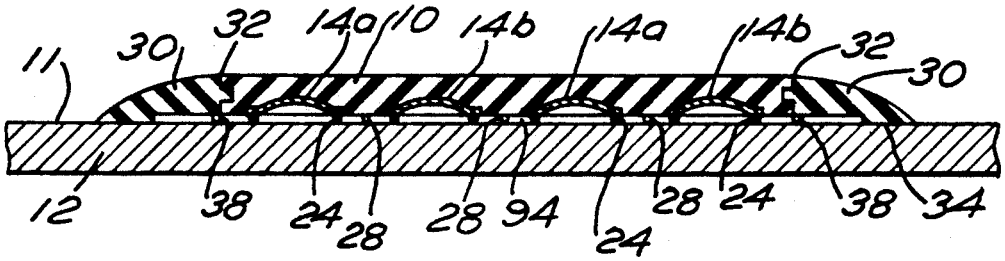

The array 10 is adhered to a hull surface 11 by a suction created in shells 14*a* and *b* as shown in FIG. 7A, trapping salt water and/or air in the spaces both under and around shells 14 as seals at face 34 are established. After attachment and sealing, a suction is maintained in the first set of shells 14*a* and an above ambient pressure introduced in a second set of shells 14*b* and in the space 94 around shells 14*a* and *b*. As shown in FIG. 7B, the above ambient pressure will cause the second set of shells 14*b* to lift off the hull surface 11 thus allowing the contact areas under the gaskets 24 and under various spacers 28 and 38 to be flushed clear of salt water and/or air. When the space under the second set of shells 14*b* and space surrounding all shells 14*a* and *b* are flushed, a suction is applied to the second set of shells 14*b* causing all shells 14*a* and 14*b* to adhere as shown in FIG. 7C. A greater than ambient pressure is then applied to the first set of shells 14*a* and the spaces 94 around all shells 14*a* and *b*. This causes the first set of shells 14*a* to lift off the hull surface 11 as shown in FIG. 7D and the flushing operation is repeated in the spaces under the lift area. Upon completion of the flushing operation a suction is applied to the first set of shells 14*a* and the spaces 94 around all shells 14*a* and *b* completing the attachment procedure. All shells 14*a* and *b* are now adhered as shown in FIG. 7E. If necessary the above procedures can be followed through several times in order to insure the exclusion of all salt water and/or air.

At this point it should be noted that if the complete flushing possible with the lifting of alternate sets of shells is not employed, that very small amounts of salt water will remain in the interstices between the gaskets and hull surfaces and between gaskets and shells and under the various spacers. The presence of salt in these interstices may not cause significant corrosion or other damage since sufficient oxygen will usually be lacking both because the oxygen cannot readily penetrate the interstices and because the treated liquid which contacts the exposed edges of the interstices is free of oxygen. Even so, it is of course considered desirable to trap as little salt as possible. This is one of the reasons for in some cases conducting the flushing operation with a small differential pressure where only the salt water under a small contact area is trapped. The differential pressure can be increased following the initial flushing operation, the additional area of contact then only trapping treated liquid. If that procedure is used there will then exist in each contact area a very thin center section of trapped salt water surrounded by sections of trapped treated liquid. The trapped treated liquid serves to isolate the trapped salt water from the body of treated liquid.

Calculations can establish the adequacy the attachment force with respect to frictional hydrodynamic drag forces attempting to make the blanket array slide. The first step is to establish the lowest liquid pressure that can exist within the suction system and not cause the liquid to boil,, i.e., the saturated vapor pressure. That pressure is a function of the highest expected temperature and the liquid used. If we assume that the highest temperature to be encountered is 122° F. and that the liquid is water, then the saturated vapor pressure is approximately 1.8 $lb/in^2$. The differential pressure between the latter and nominal atmospheric pressure of 14.7 $lb/in^2$ is 12.9 $lb/in^2$ or 1,1857 $lb/ft^2$. It is estimated that the fraction of the surface used would be about 0.6 for circular shells. The coefficient of friction for rubber sliding on smooth paint in a wet environment is approximately 0.27 to 0.37. The more conservative 0.27 is used here. From the preceding the resistance to sliding force is 300 $lb/ft^2$. Frictional hydrodynamic drag forces are approximately proportional to the velocity squared. Typical values are approximately 1 $lb/ft^2$ for 10 knots, 4 $lb/ft^2$ for 20 knots, and 16 lb/ft for 40 knots. One can see there is probably an adequate safety margin with respect to frictional hydrodynamic drag. The additional environmental pressure caused by the blanket array's position at some finite depth below the water's surface would of course increase this margin.

The total force field affecting the array is complex. In addition to the frictional forces discussed in the preceding paragraph there will be both static and dynamic forces acting along various directional vectors. Of particular interest are forces tending to pull the array off the hull since even if they do not succeed they will tend to weaken the array's resistance to sliding forces. Those pulling forces which are caused by a vessel's speed tend to be static and occur at specific hull locations. They can be avoided or reduced by careful array placement. Those pulling forces which are caused by rough weather tend to be dynamic but can be partially discounted since a vessel may slow during rough weather thus substantially reducing frictional drag forces.

There is a possibility that gaskets may hydroplane on a film of liquid. The onset of hydroplaning can be reduced by keeping the gasket contact pressure per unit area as high as possible. The use of gasket types such as O-rings as contrasted to flat gaskets should result in a relatively high pressure per unit area that should tend to wipe or squeeze the gasket contact surface and thus reduce the quantity of liquid trapped.

Chemical indicating agents can be incorporated in the fresh water and the treated liquid that change color or otherwise indicate the presence of dissolved salts, oxygen, or other contaminents.

Various modifications and alternatives can be applied to the described liquid suction adhesion system.

Subsequent to the flushing procedure, the interior of the shells can if desired be evacuated of all liquid but it must be kept in mind that this may have several disadvantages. The disadvantages are that evacuated spaces may exhibit a low acoustic impedance and this low impedance may interfere with the response of the sonar elements and vacuum-filled shells and other components may not be able to sustain shock forces such as may derive from impacts or shock waves. Conversely, such vacuum-filled spaces may deliberately be designed to be part of an acoustic baffle, a baffle for any purpose or combination of purposes.

An alternative flushing system configuration could involve keeping a supply and discharge tank or combination supply and discharge tank with a flexible separator and other system components at the same less than ambient pressure thus obviating the need for the pressure regulating valves indicated.

The transparent portions of the array can be covered with an adhesion tape opaque to visible and/or ultraviolet light to protect the transparent and other materials from deterioration due to exposure to solar and other radiation. Such a tape may also be required for asthetic or camouflage reasons. If such tape utilized a non-setting adhesive it would be easily removed and replaced for inspection purposes. Chemicals or materials which are transparent to visible light but opaque to damaging ultraviolet light might be incorporated in various transparent and non-transparent materials of the array.

The shells can be configured other than in a circular shape. For example, those on the periphery of the array can have a flat side facing the edge of the array, the objective being to position the strong attachment force represented by the shells as close to the array edge as possible. These peripheral shells may be configured to form the faired edge of the array and incorporate the described transparent sealing means within and around themselves. In the latter case the seal would be required to sustain a full differential pressure. Other shells might be octagonally shaped to allow the shells to cover a high percentage of the surface area. In all cases corners of shells would be rounded enough to accommodate the type of gasket used. The peripheral shells can be mechanically connected to the peripheral sealing means to impart some of their adhering force to the peripheral seal.

The blanket array adhesion system described can be used to mount an array or other device on a wide variety of surfaces and structures in addition to an exterior hull surface. Such surfaces can include exterior or interior sonar dome and sonar window surfaces, exterior or interior bulkhead surfaces, on existing arrays, projectors, transducers, various exterior and interior baffle surfaces, between various surfaces, etc. If there is no flow over the array or other susceptible components, then fairings, dimpling problems, etc. may not be of concern and this would be reflected in the portion of the attachment system retained.

The blanket array adhesion system described may be employed to adhere a blanket array whose parts may be readily disassembled for maintenance and updating purposes. In some cases the suction and flushing systems may be employed to hold such a blanket array together. For example, sonar components, etc, might be sandwiched in liquid-filled spaces between layers, Such spaces might be contoured to accommodate hydrophones, transducers, preamplifiers, cables, etc. The layers would be held together by a liquid maintained at a lower than ambient pressure which fills the spaces between layers.

Cathodic corrosion protection means can be incorporated within the liquid suction adhesion system described. There are various methods of achieving cathodic protection. One method would involve the distribution of zinc or other sacrificial electrodes within or in contact with the liquid-filled spaces. Another method would involve a permanent conductive grid installed in the array so that it was in contact with the liquid-filled spaces. Such a grid would be connected to a suitable source of electrical potential.

The hull or other surface to which the blanket array is adhered may under some conditions be specially prepared for the array installation. This preparation can include the prior installation of a sheet to the hull surface such as a sheet of transparent or non-transparent plastic, glass, rubber, etc. It might also consist of a sheet of metal such as stainless steel. A sheet may or may not be coated prior to installation. Adhesives, welding, etc. may be employed to fasten such a sheet. The preparation can also consist of a coating or series of coatings such as paint, enamel, vitreous glaze, etc. Metal plating techniques might also be applied to the installation area and might include zinc, chrome, the noble metals, etc.

In some cases studs welded or otherwise attached to a hull surface can serve as both guides for the array installation and as a backup attachment means that can save the array in the event the suction attachment system fails. Due to increased selfnoise and other problems a blanket array may not remain acoustically operable when the suction system is not working. By means of gaskets, tubes, and other sealing and separating methods such studs can penetrate the suction system to the vicinity of the array exterior. The top portion of a stud and its associated fastener would fit into a recess in the external blanket array surface and be accessible to installation personnel. A relatively few widely spaced studs would be required. Other backup fastening means involving anchored cables, bands, clamps, magnets, etc. can also be employed.

Both flexible and rigid reinforcements can be incorporated in the blanket array and the suction adhesion system described. In one form such reinforcement can be analogous to the reinforcements in rubber automobile tires. In some configurations the reinforcements can be rigidly or flexibly attached to array components including the suction shells and the peripheral sealing strip.

The described attachment system can also be utilized to secure arrays or other objects and devices on a wide variety of surfaces. It can also be utilized as an attachment means for towing, lifting, mooring, maneuvering, or other similar purposes. In some cases the attachment environment may not be underwater.

There has therefore been described several embodiments of an adhesion system for blanket arrays that can be quickly installed or removed either above or below the water surface with a minimum of hull preparation, can be installed and removed without damage to itself or to a protective coating on a hull surface, and can remain installed for an extended period of time with a minimum of corrosion to the vessel's hull.

The first two advantages are of particular value to short-term installations such as might be required for noise tests and range navigation equipment. Also, these advantages allow long-term blanket array installations to be conveniently removed for short periods for hull inspection and maintenance purposes, The third advantage is primarily of value to long-term installations where damage or deterioration sustained by a blanket array and its adhesive bond and the possible resultant hull corrosion can pose a threat to hull integrity.

The adhesion system includes means for attaching a blanket array to a hull surface by a liquid suction system, means for flushing salt water and/or air from the space between the blanket array and the hull surface, means to replace the aforementioned salt water and/or air with liquid treated to inhibit corrosion and other deteriorating processes, and means for inspecting and monitoring the state of the attachment means particularly as relates to hull corrosion. The various configurations protect the array from excessive dimpling due to pressure differentials including dynamic pressure differentials caused by depth changes. Details include rigid suction shells, their incorporation into a flushing and pressure maintenance system, the incorporation of spaces not covered by shells into a similar flushing and pressure, maintenance system, and a peripheral inspectable transparent seal.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A blanket transducer array system adapted to be adhered to the external hull of a vessel comprising:

a transducer array;

an elastomeric sheet material containing said transducer array;

a first adhering means including a plurality of rigid shells spaced on and fastened to one surface of said elastomeric sheet material for attaching said elastomeric sheet material to the external hull of the vessel;

a first control means connected to said first adhering means for selectively providing a fixed amount of adherence between said shells and hull;

a second adhering means including said surface of said elastomeric sheet material surrounding said shells for attaching said elastomeric sheet material to the external hull of the vessel;

a second control means connected to said second adhering means for selectively providing a fixed amount of adherence between said elastomeric sheet material and the external hull of the vessel;

supply means for supplying fluid to said first and second adhering means and said first and second control means; and an adhesive elastomer strip located at the perimeter of the elastomeric sheet material for attaching and sealing the perimeter of the elastomeric sheet material to the hull.

2. A system for adhering a blanket transducer array according to claim 1 wherein said supply means further comprises:

first and second fluid supplies;

first selecting means for selecting one of said first and second fluid supplies; and second selecting means having an inlet connected to said first selecting means for receiving the selected one of said first and second fluid supplies and having a pair of outlets for supplying the selected one of said first and second fluid supplies through a selected one of said pair of outlets.

3. A system for adhering a blanket transducer array according to claim 2 wherein said first control means further comprises:

input means connected to one of said pair of outlets for supplying the selected one of said first and second fluid supplies to said rigid shells;

output means for removing the selected one of said first and second fluid supplies from said rigid shells; and pressure control means for controlling the pressure within said shells.

4. A system for adhering a blanket transducer array according to claim 3 wherein said first control means further comprises circulation means for flushing said rigid shells with vortex liquid circulation utilizing the selected one of said first and second fluid supplies.

5. A system for adhering a blanket transducer array according to claim 4 wherein said second control means further comprises:

input means connected to one of said pair of outlets for supplying the selected one of said first and second fluid supplies to said area surrounding said rigid shells;

output means for removing the selected one of said first and second fluid supplies from said area surrounding said rigid shells; and pressure control means for controlling the pressure in said area surrounding said shells.

6. A system for adhering a blanket transducer array according to claim 5 wherein said second control means includes a plurality of spacers between said area surrounding said shells and said hull.

7. A system for adhering a blanket transducer array according to claim 6 wherein said adhesive elastomer strip further comprises:

an adhesive inner face suitable for the creation of an adhesive seal with said hull surface; and configuration means for transmitting part of a differential pressure to said adhesive strip for allowing treated liquid to circulate up to the inner boundary of said adhesive strip and for permitting observation of said strip and said surface under the strip to insure the quality of the seal and the freedom from corrosion and other damage of the hull surface under and adjacent to said seal.

* * * * *